United States Patent [19]

Tillinghast et al.

[11] 4,127,950

[45] Dec. 5, 1978

[54] BOTTOM JETTING DEVICE

[75] Inventors: William S. Tillinghast, Humble; William R. Rochelle, Houston, both of Tex.

[73] Assignee: Brown & Root, Inc., Houston, Tex.

[21] Appl. No.: 802,819

[22] Filed: Jun. 2, 1977

[51] Int. Cl.[2] ..... E02F 3/88

[52] U.S. Cl. ..... 37/62; 302/15

[58] Field of Search ..... 37/61-63, 37/78, 55, 56, , 72, 119; 302/58, 15

[56] References Cited

U.S. PATENT DOCUMENTS

| | | | |
|---|---|---|---|
| 619,727 | 2/1899 | Davis | 37/62 |
| 908,113 | 12/1908 | Lovett | 37/62 |
| 1,719,668 | 7/1929 | McEachern | 37/63 |
| 2,906,040 | 9/1959 | Hefling | 37/62 |
| 3,543,422 | 12/1970 | Plutchak | 37/72 X |
| 3,572,129 | 3/1971 | Walthier et al. | 37/56 UX |

FOREIGN PATENT DOCUMENTS

| | | | |
|---|---|---|---|
| 141355 | 5/1950 | Australia | 37/119 |

*Primary Examiner*—Clifford D. Crowder

*Attorney, Agent, or Firm*—Kenway & Jenney

[57] ABSTRACT

The invention relates to a device for removing material from a submerged surface. The apparatus has a liquid manifold which supports downwardly directed liquid jets to dig or remove material and upwardly directed liquid jets to impel the removed material into the interior of a material removing housing and a gas manifold having a plurality of air jets to help urge the material into and through the material removing housing. Means are provided for dividing the liquid and gas manifolds into zones and for directing all of the supplied liquid and gas to one or more zones of the respective manifolds to either intensify and localize the effect of the fluids or to maintain the device in an operable condition when the source of gas and/or liquid is partially impaired.

10 Claims, 11 Drawing Figures

Fig. 6.
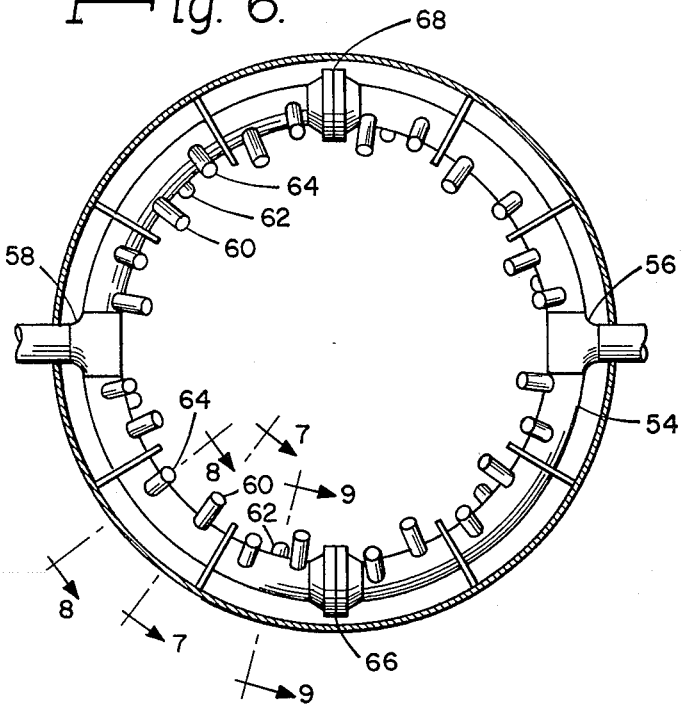
Fig. 7.
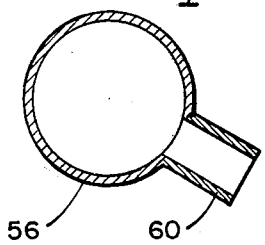
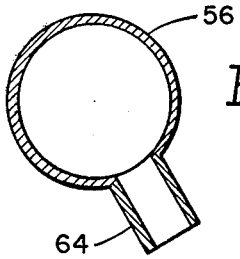
Fig. 8.
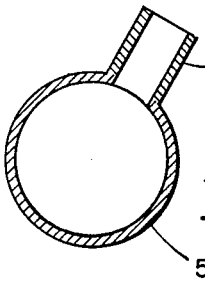
Fig. 9
Fig. 10.
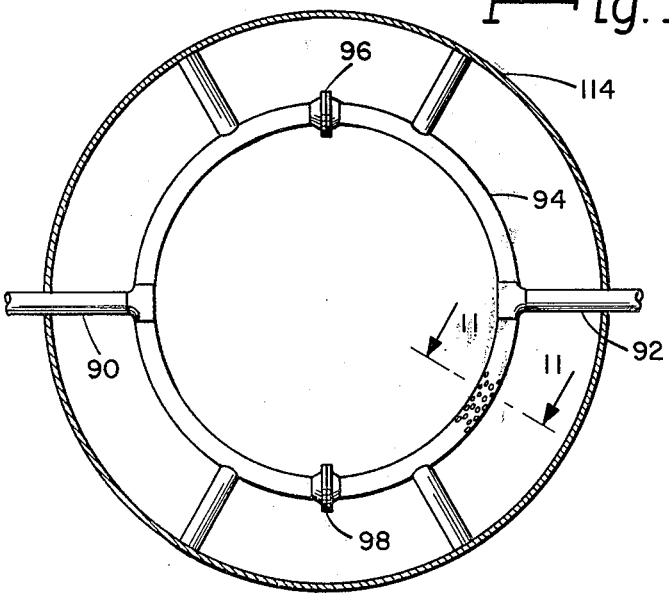
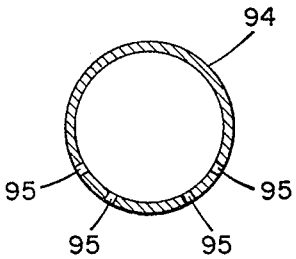
Fig. 11.

BOTTOM JETTING DEVICE

The invention relates generally to apparatus for removing material from a submerged surface and in particular to apparatus for removing material from submerged surfaces using water under pressure to dig and compressed air to aid in removal of the material.

BACKGROUND OF THE INVENTION

Dredging devices for removing material hydraulically from a submerged surface have long been known. These devices are generally suspended from a vessel and are supplied with water or other fluids under pressure to dig and otherwise remove material from the submerged surface in order to, for example, lay a buried pipe or to clear a channel in a harbor.

These early material removing devices have all been incapable of operating effectively unless a prescribed fluid delivery capability for the entire device was available. Thus, the unit could not function sufficiently at, for example, a flow rate of half what was required for the entire unit. Also, these devices could not localize the digging action on command in order to concentrate the digging action at a particular location.

It is therefore an object of this invention to provide apparatus for removing material from a submerged surface which is capable of directing the applied hydraulic fluid material to one or more zones of the device whereby the jetting action is localized and the device may function effectively even though the source of pressurized fluid is limited or impaired. Other objects of the invention include providing a stable and controllable apparatus capable of resting on the submerged surface and an apparatus in which both water and air urge the removed material into a material receiving housing to remove the material from the area from which it was removed.

SUMMARY OF THE INVENTION

The jetting and material removing apparatus of the present invention features a housing, a liquid transmitting manifold means, a gas transmitting manifold means, a removed material discharging means and a liquid jetting intensifying and localizing means.

The housing has a generally upright axis when the apparatus is disposed in a submerged location to effect material jetting and removal. The housing further includes a generally downwardly facing, material receiving opening extending generally transversely of the upright axis and above the surface to be jetted, and operable to receive material jetted free of the surface. The housing can be supported by a flexible cable or other means which extends downwardly through the water from the floating vessel.

The liquid transmitting manifold is connected with the housing and includes a plurality of at least partially downwardly directed jetting nozzles to direct material-removing jets of liquid against the submerged surface to remove material therefrom. The manifold also includes a plurality of at least partially upwardly directed nozzles to impel material which has been removed from the submerged surface by the jetting nozzles upwardly into the interior of the housing.

The gas transmitting manifold has a plurality of gas outlets to direct pressurized gas into the interior of the housing and to provide a lift effect acting on the material removed from the submerged surface by the jetting nozzles. The gas lift effect tends to urge or induce upward passage of the removed material through the housing. The removed material discharging means is connected with an upper portion of the housing to receive the removed material from the interior of the housing and to transmit it to the exterior of the housing.

The liquid jet intensifying and localizing means features a liquid transmitting manifold divider to divide the liquid transmitting-manifold into a plurality of separate and independently operable jetting and lifting zones. Each zone contains at least some of the jetting nozzles and at least some of the material impelling nozzles. The intensifying and localizing means further includes liquid flow control means selectively operable to direct liquid alternately to selected ones of the jetting and lifting zones or to direct the liquid to the totality of the jetting and lifting zones.

The liquid transmitting manifold divider and the liquid flow control means are selectively operable in cooperation to intensify and localize the material removing and impelling effects provided by the jetting and material impelling nozzles in the vicinity of a selected one of the jetting and lifting zones.

Like the liquid jet intensifying and localizing means, the gas lift intensifying and localizing means also features a divider means and flow control means to selectively direct the flow of gas to one of a plurality of independent zones or in the alternative to all of the zones. Thus, the gas transmitting manifold is operable in cooperation with the gas flow control to intensify and localize the gas-lift effect provided by the gas outlets in the vicinity of a selected one of the lift zones.

In other aspects, the liquid and gas transmitting manifolds each feature a generally annular, fluid conduit located within the housing, generally above the material receiving opening and generally encircling the axis of the housing. The liquid conduit supports the jetting nozzles on its underside and the material impelling nozzles on an upper side. The gas conduit supports gas outlets on its underside.

The liquid and gas transmitting manifold dividers, in a preferred embodiment, each feature a pair of selectively operable fluid conduit closures extending generally transversely across diametrically opposite interior portions of their respective conduit. The closures are selectively operable to divide the conduit into two jetting or lifting zones, each extending substantially halfway about the interior of the housing. The fluid conduit closures are also selectively operable to provide fluid communications between the two zones.

The liquid and gas fluid flow control means in the preferred embodiment, each feature a first fluid supply conduit to transmit pressurized fluid to the respective first zone, a second fluid supply conduit to transmit pressurized fluid to the respective second zone, a first selectively operable valve to control the flow of fluid through the first supply conduit and a second selectively operable control valve to control the flow of fluid through the second supply conduit.

The housing further features a generally cylindrical outer shell, a generally annular anti-embedment rim carried by the outer shell, extending transversely outwardly from a lower portion of the shell and operable to impede embedment of the housing in the submerged surface. Preferably, the housing has a generally fustoconical, downwardly diverging wall transversely bridging the outer shell above the material receiving opening and communicating with the material discharge means at an upper apex of the generally fusto-conical wall.

The apparatus further features a plurality of web means circumferentially spaced about the exterior of the housing and connected with and radiating downwardly from the cylindrical outer shell. The web is connected with the anti-embedment rim and provides a connection between the anti-embedment rim and the cylindrical outer shell to provide anti-deflection means supporting the upper side of the anti-embedment rim.

The apparatus still further features a buoyancy chamber carried by the housing beneath a transversely projecting portion of the removed material discharge means and a plurality of balancing means dispersed circumferentially about the housing and operable to selectively support a ballasting means at a plurality of circumferentially dispersed ballasting locations relative to the housing.

DESCRIPTION OF THE DRAWINGS

Other advantages, features and objects of the invention will appear from the following description of a preferred embodiment of the invention taken together with the drawings in which:

FIG. 6 is a bottom view of the liquid transmitting manifold and manifold divider according to the invention;

FIG. 7 is a cross-sectional view taken along lines 7—7 of FIG. 6;

FIG. 8 is a cross-sectional view taken along lines 8—8 of FIG. 6;

FIG. 9 is a cross-sectional view taken along lines 9—9 of FIG. 6;

FIG. 10 is a top view of the gas transmitting manifold and manifold divider of the bottom jetting device according to the invention; and FIG. 11 is a cross-sectional view taken along the lines 11—11 of FIG. 10.

DESCRIPTION OF A PREFERRED EMBODIMENT

Figure 1:
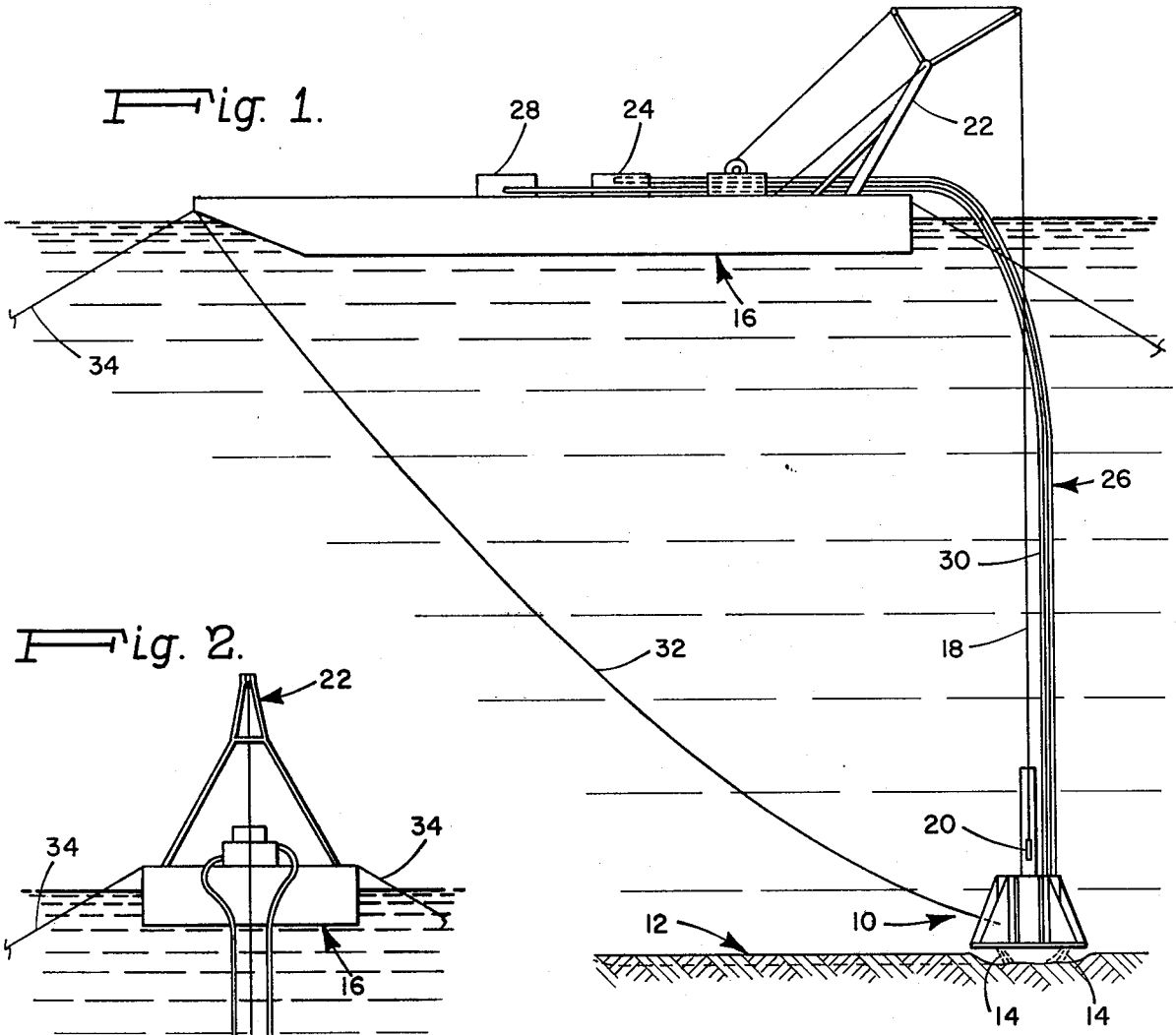
FIG. 1 is a schematic overview showing the bottom jetting apparatus of the invention and the general environment in which the invention is used.
Figure 2:
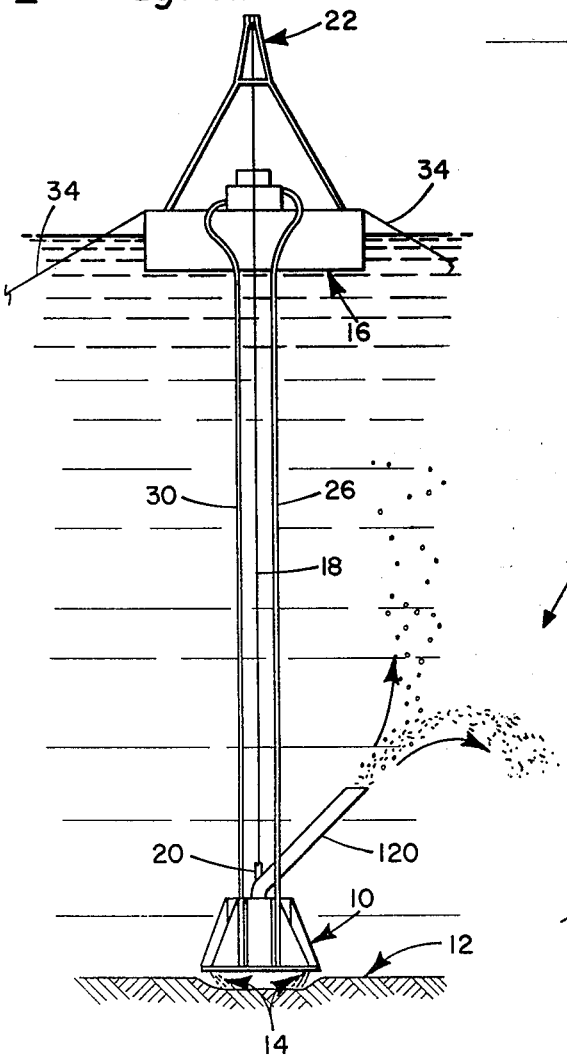
FIG. 2 is an end view of the arrangement shown in FIG. 1.

Referring to FIG. 1, a bottom jetting apparatus 10 for jetting and removing material from a submerged surface 12 is shown supported just above the surface. Jetting nozzles at the bottom of the apparatus direct streams 14 of liquid, generally water, at the submerged surface, freeing material which is then urged or impelled upward and into a removed material discharge means within the apparatus. The removed material is discharged from the apparatus to a location transversely displaced from the apparatus. The bottom jetting apparatus 10 is supported from a floating vessel 16 by a flexible means for example cable 18 which is connected to a lifting padeye 20 of the bottom jetting device. Cable 18 is threaded through and supported by a crane assembly 22 aboard the floating vessel.

The machinery required to operate the jetting apparatus is located on the floating vessel. Liquid pumps 24 provide liquid at high pressure and high flow rate through a hose 26 to the bottom jetting device. A gas compresser 28 provides gas, at high pressure, through a hose 30 to the bottom jetting apparatus.

The apparatus is maintained in a correct position relative to the vessel by a tow cable 32 connected to a second padeye 33 on the apparatus. The floating vessel may be anchored by corner anchoring lines 34.

Figure 4:
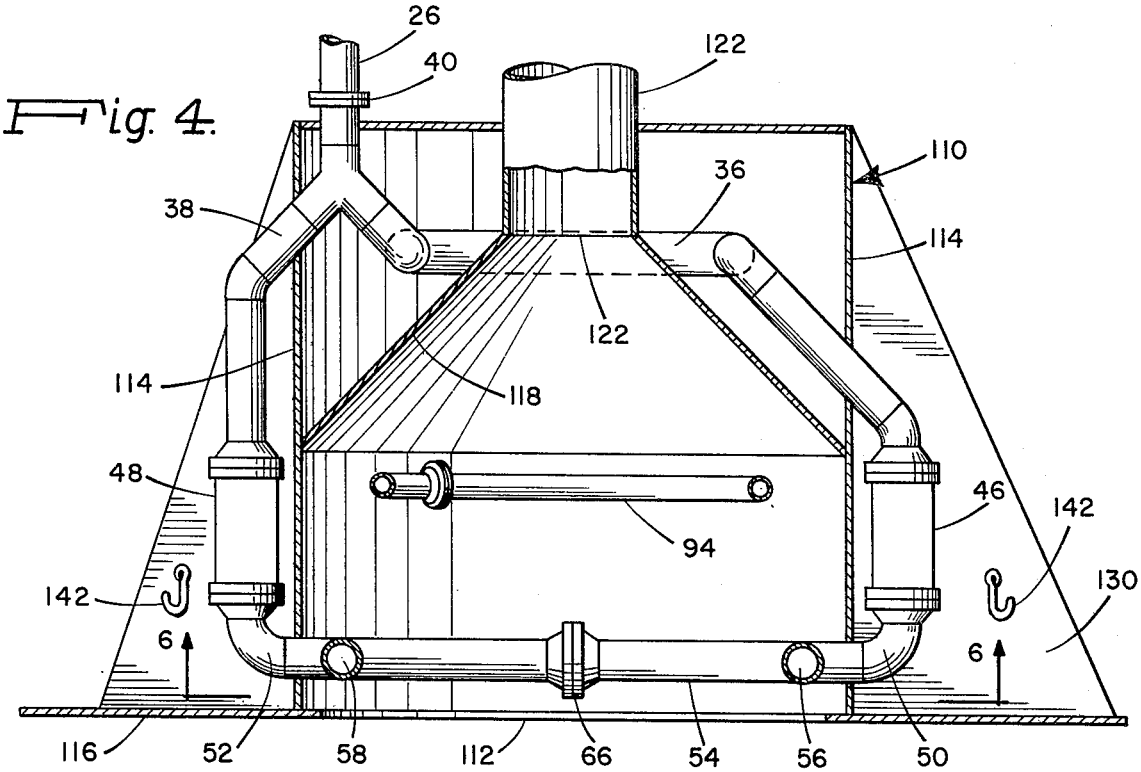
FIG. 4 is a side, partially broken, cross-sectional view showing the liquid distribution arrangement of the bottom jetting apparatus.

Hose 26 connects to the bottom jetting apparatus 10 through a coupling 40 (FIG. 4). Hose 26 is coupled to a liquid transmitting distribution system which directs the liquid in a plurality of supply conduits or paths 36, 38. The flow of liquid in each path is controlled, in the preferred embodiment, by selectively operable, liquid valves 46, 48. Valves 46, 48 are connected, at their outputs to liquid supply conduits 50 and 52 which supply the pressurized liquid to a liquid transmitting manifold 54.

The liquid supply conduits 50, 52 are connected to manifold 54, in the preferred embodiment, at 56, 58, which are disposed at diametrically opposed locations on liquid transmitting manifold 54. In the preferred embodiment, manifold 54 is a generally annular conduit. Manifold 54 supports nozzles 60, 62 and 64 (FIGS. 6-9). Preferably, jetting nozzles 60 and 64 are directed downward, toward the submerged surface, at angles of 30° and 60° to the horizontal respectively. Impelling nozzles 62, in the preferred embodiment, are directed upwardly at an angle of 60° to the horizontal. Each group of nozzles is equally spaced around the circumference of manifold 54. In the preferred embodiment there are twelve each of downwardly directed jetting nozzles 60 and 64, and six upwardly directed nozzles 62. Nozzles 60 and 64 are directed against the submerged surface to remove material therefrom and nozzles 60 are directed upwardly to impel material removed from the submerged surface by the jetting nozzles 64 and 60, upward and into the interior of a material discharge apparatus.

Manifold 54 is divided into a plurality of separate zones by a liquid transmitting manifold divider. The liquid manifold divider, in the preferred embodiment, divides manifold 54 into two zones. The divider includes a pair of selectively operable liquid conduit closures 66, 68 which extend generally transversely across diametrically opposed opposite interior portions of the manifold 54. Closures 66, 68 may comprise valves or "line blinds" and can be selectively operated or manipulated to provide either liquid communication between the two zones or to provide separation and isolation between the two zones.

Figure 5:
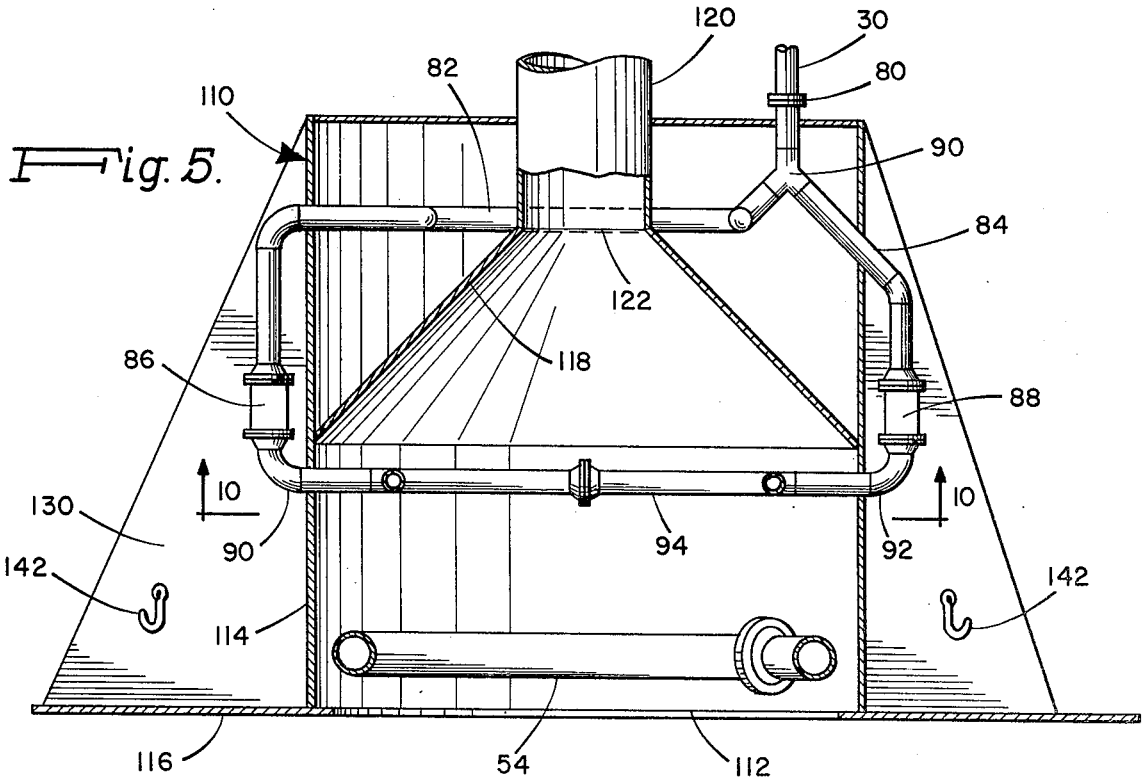
FIG. 5 is a side, partially broken, cross-sectional view showing the gas distribution arrangement of the bottom jetting apparatus.

Referring to FIG. 5, hose 30 is coupled by a coupling 80 to a gas flow control means which directs the compressed gas along a plurality of paths corresponding to the liquid flow paths. The compressed gas is coupled to gas supply conduits 82 and 84. Conduits 82 and 84 are connected to selectively operable gas valves 86 and 88. The output of valves 86, 88 are connected through supply conduits 90, 92 to a gas manifold 94. Like liquid manifold 54, gas manifold 94 is preferably an annular conduit and has a plurality of gas outlets 95 around its circumference. Manifold 94 is divisible into a plurality of zones by a gas manifold divider. In the preferred embodiment, the gas manifold divider comprises selectively operable gas conduit closures 96, 98 (FIG. 10)

which divide the manifold 94 into two gas lift zones. Closures 96, 98 preferably extend transversely across diametrically opposite interior portions of annular manifold 94. Thus supply conduits 82, 90 and valve 86 supply gas to one gas lift zone and conduits 84, 92 and valve 88 supply gas to the second gas lift zone.

The bottom jetting apparatus 10 is contained in a housing 110 which has a generally upright axis when the apparatus is disposed in a submerged location. The housing has a generally downwardly facing material receiving opening 112 which extends generally transversely to the upright axis.

Housing 110 has a generally cylindrical outer shell 114. Outer shell 114 carries a generally annular anti-embedment rim 116 which extends transversely outward from a lower portion of the housing. Anti-embedment rim 116 is intended to impede embedment of the housing in the submerged surface from which material is being removed. Housing 110 also includes a generally fusto-conical, downwardly diverging wall member 118 which transversely bridges the outer shell above the material receiving opening 112 and communicates with a material discharging means 120 at its upper apex portion 122. The material discharging means 120 receives material from within the housing and transmits it to the exterior of the housing. In the preferred embodiment, the discharge means is a cylindrical pipe which extends transversely from the housing axis and from apex 122 to a point away from a side of the jetting apparatus.

Manifolds 54 and 94 are located within the housing 110, above the material receiving opening 112. The gas manifold 94 is positioned above the liquid transmitting manifold 54.

The jetting device further includes web means 130 spaced circumferentially around the exterior of the housing. Web means 130 comprises rigid plates connected to the cylindrical outer shell of the housing and radiating outwardly therefrom. The web means is also connected with the anti-embedment rim and the resulting connection between the anti-embedment rim and the cylindrical outer shell provides anti-deflection means supporting the upper side of the anti-embedment rim.

Figure 3:
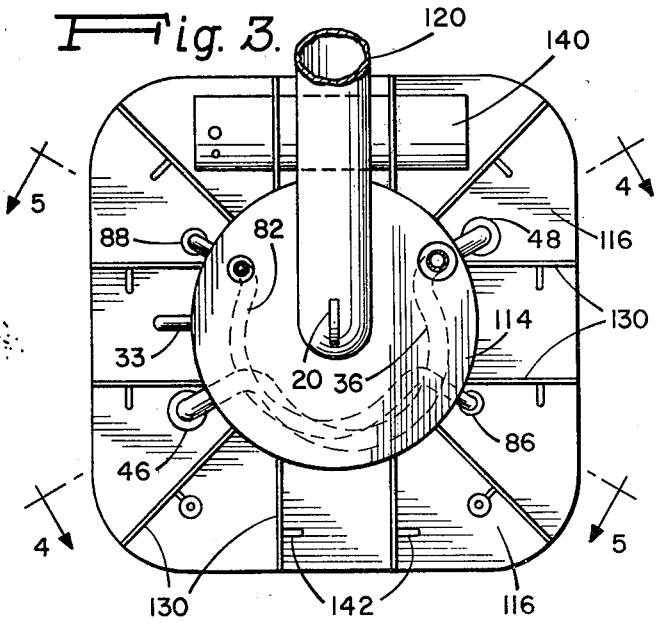
FIG. 3 is a top view of the bottom jetting apparatus according to the invention.

The jetting apparatus further includes a means for balancing the apparatus during operation. The balancing means includes a buoyancy chamber 140 (FIG. 3) carried by the housing beneath the transversely projecting portion of the material discharge means 120. The buoyancy chamber tends to couter-balance the weight of the discharge chamber. In addition, a plurality of second balancing devices 142 are dispersed circumferentially about the housing. In the preferred embodiment, balancing devices 142 comprise round bar hooks attached to web means 130 for hanging trimming ballast if they are required. Thus devices 142 are operable to selectively support the ballast at a plurality of circumferentially dispersed balancing locations relative to the housing.

In operation, the bottom jetting apparatus is lowered near the submerged surface and liquid at high pressure is directed to the jetting nozzles to remove the material beneath the nozzles. The freed material, under the effect first of the impelling nozzles, and then, due to the aeration effect of the gas nozzles is urged into discharge means 120 for removal to the side of the area being scoured.

As necessary, the jetting energy can be intensified and localized by directing the liquid and/or gas to only selected zones of the apparatus. Thus, for example, if one of the water pumps fails, or only a low capacity pump should be available, the reduction in flow rate and pressure does not terminate effective operation of the device. This benefit results from being able to channel the available fluid energy into half of the fluid discharge system.

SUMMARY OF MAJOR ADVANTAGES AND UNOBVIOUSNESS

It will be appreciated by those skilled in the art that the disclosed bottom jetting apparatus provides a structure for reliably and efficiently removing material from the submerged surface of a body of water.

Further, the described apparatus for removing material provides a highly advantageous system of directing water to all or only a portion of the fluid manifolds in order to concentrate the jetting action at a particular portion of the submerged surface. This ability to intensify and localize the fluid in a particular zone also compensates for the inability to supply fluid at high pressure, for example due to a malfunction on board the vessel.

Another advantage of the present invention is the stability provided by the balancing devices and the ability to rest on the submerged surface of the body of water without sinking into soft ground.

The apparatus claimed herein provides a unique system combining both efficiency and stability of operation. Other apparatus have been disclosed for dredging or material removing purposes. Thus, Mansfield U.S. Pat. No. 292,024 is perhaps one of the earliest hydraulic excavating patents. There have followed: Lovett U.S. Pat. No. 908,113, Moore U.S. Pat. No. 890,245, Schacht U.S. Pat. No. 2,125,740, Hefling U.S. Pat. No. 2,906,040, Elliott U.S. Pat. No. 2,879,649, and Good et al U.S. Pat. No. 3,786,642. Each of these patents relates to dredging or material removing devices which employ jets of water and air in various combinations and structures but do not suggest the inventive concept here under consideration.

Other embodiments of the invention will occur to those skilled in the art and are within the following claims.

What is claimed is:

1. An apparatus for jetting and removing material from a submerged surface, said apparatus comprising:

housing means having a generally upright axis when said apparatus is disposed in a submerged location to effect material jetting and removing in relation to a submerged surface, a generally downwardly facing, material-receiving opening means extending generally transversely of said upright axis, said housing means being operable to be supported by means extending downwardly from floating vessel means through a body of water, with said material-receiving opening means being disposed above a submerged surface to be jetted and operable to receive material jetted free of said surface;

liquid transmitting manifold means connected with said housing means and including a plurality of at least partially downwardly directed jetting nozzles operable to direct material-removing jets of liquid against said submerged surface and remove material therefrom, and a plurality of at least partially upwardly directed material impelling nozzles operable to impel material removed from said submerged surface by said jetting nozzles upwardly into the interior of said housing means;

gas transmitting manifold means including a plurality of gas outlets operable to direct pressurized gas into the interior of said housing means and provide a gas lift effect acting on said material removed from said submerged surface by said jetting nozzles and tending to induce upward passage of said removed material through said housing means;

removed material discharging means connected with an upper portion of said housing means, said material discharging means being operable to receive said removed material from the interior of said housing means, and transmit said removed material to the exterior of said housing means; and liquid jetting intensifying and localizing means including liquid-transmitting manifold divider means operable to divide said liquid-transmitting manifold means into a plurality of separate and independently operable jetting and lifting zones, each containing at least some of said jetting nozzles and at least some of said material impelling nozzles, and liquid flow control means selectively operable to direct liquid alternately to selective ones of said jetting and lifting zones and direct said liquid to the totality of said jetting and lifting zones;

said liquid-transmitting manifold divider means and said liquid flow control means being selectively operable, in cooperation, to intensify and localize the material removing and impelling effects provided by said jetting nozzles and material impelling nozzles of said liquid-transmitting manifold means in the vicinity of a selected one of said jetting and lifting zones, or provide generally uniform jetting and lifting effects throughout the interior of said housing means.

2. An apparatus as described in claim 1 wherein:

said liquid-transmitting manifold means includes generally annular, liquid conduit means located within said housing means generally above said material-receiving opening means, and generally encircling said generally upright axis of said housing means, said generally annular liquid conduit means supporting said jetting nozzles on an underside thereof and supporting said material impelling nozzles on a upper side thereof;

said liquid-transmitting manifold divider means includes a pair of selectively operable liquid conduit closure means extending generally transversely across generally diametrically opposite interior portions of said generally annular liquid conduit means of said liquid-transmitting manifold means and selectively operable to divide said generally annular liquid conduit means of said liquid-transmitting manifold means into first and second jetting and lifting zones, each extending substantially halfway about the interior of said housing means and partially encircling said generally upright axis of said housing means, said selectively operable liquid conduit closure means being further selectively operable to provide liquid communications between said first and second jetting and lifting zones; and said liquid flow control means includes first liquid supply conduit means operable to supply pressurized liquid to said first jetting and lifting zone, first selectively operable, liquid valve means operable to control the flow of pressurized liquid through said first liquid supply conduit means, second liquid supply conduit means operable to supply pressurized liquid to said second jetting and lifting zone, and second selectively operable liquid valve means operable to control the flow of pressurized liquid through said second liquid supply conduit means.

3. An apparatus as described in claim 1 further comprising:

gas lift intensifying and localizing means including gas transmitting manifold divider means operable to divide said gas transitting manifold means into a plurality of separate and independently operable gas lift zones, each containing at least some of said gas outlets and being disposed generally above a said jetting and lifting zone, gas flow control means selectively operable to direct gas alternately to selective one of said gas lift zones and direct gas to the totality of said gas lift zones;

said gas transmitting manifold divider means and said gas flow control means being selectively operable, in cooperation, to intensify and localize the gas-lift effect provided by said gas outlets of said gas transmitting manifold means in the vicinity of a selected one of said gas lift zones, or provide a generally uniform gas-lift effect throughout the interior of said housing means.

4. An apparatus as described in claim 3 wherein:

said gas transmitting manifold means includes generally annular gas conduit means located within said housing means generally above said material receiving opening means and generally above said liquid-transmitting manifold means and generally encircling said generally upright axis of said housing means, said generally annular gas conduit means supporting said gas outlets on an underside thereof;

said gas-transmitting manifold divider includes a pair of selectively operable gas conduit closure means extending generally transversely across generally diametrically opposite interior portions of said generally annular gas conduit means of said gas transmitting manifold means and selectively operable to divide said generally annular gas conduit means of said gas-transmitting manifold means into first and second gas lift zones, each extending substantially halfway about the interior of said housing means and partially encircling said generally upright axis of said housing means, said selectively operable gas conduit closure means being further selectively operable to provide gas communications between said first and second gas lift zones; and said gas flow control means includes first gas supply conduit means operable to transmit pressurized gas to said first gas lift zone, first selectively operable gas valve means operable to control the flow of pressurized gas through said first gas supply conduit means, second gas supply conduit means operable to supply pressurized gas to said second gas lift zone, and second selectively operable gas value means operable to control the flow of pressurized gas through said second gas supply conduit means.

5. An apparatus as described in claim 1 wherein:

said housing means includes a generally cylindrical outer shell extending at a lower portion below said material-removing nozzles;

a generally annular, anti-embedment rim carried by said outer shell and extending transversely outwardly from a lower portion thereof, said anti-embedment rim being operable to impede embedment of said housing means in said submerged surface from which material is to be removed; and a generally frusto-conical, downwardly diverging wall transversely bridging said outer shell above said material-receiving opening means and communicating with said removed material discharging means at a upper apex portion of said generally frusto-conical downwardly diverging wall.

6. An apparatus as described in claim 5 wherein:

said apparatus further includes a plurality of web means, circumferentially spaced about the exterior of said housing means, connected with said cylindrical outer shell, and radiating outwardly therefrom;

said web means being connected with said anti-embedment rim and providing a connection between said anti-embedment rim and said cylindrical outer shell operable to provide anti-deflection means supporting an upper side of said anti-embedment rim.

7. An apparatus as described in claim 1 wherein:

said removal material discharge means extends transversely of said generally upright axis of said housing means, toward one side thereof;

said apparatus further includes first balancing means including buoyancy chamber means carried by said housing means beneath a transversely projecting portion of said removed material discharge means, and a plurality of second balancing means dispersed circumferentially about said housing means and operable to selectively support, during continuing operation of said apparatus, ballasting means at a plurality of circumferentially dispersed ballasting locations relative to said housing means.

8. An apparatus as described in claim 1 wherein:

said liquid-transmitting manifold means includes generally annular, liquid conduit means located within said housing means generally above said material-receiving opening means, and generally encircling said generally upright axis of said housing means, said generally annular liquid conduit means supporting said jetting nozzles on an underside thereof and supporting said material impelling nozzles on an upper side thereof;

said liquid-transmitting manifold divider means includes a pair of selectively operable liquid conduit closure means extending generally transversely across generally diametrically opposite interior portions of said generally annular liquid conduit means of said liquid-transmitting manifold means and selectively operable to divide said generally annular liquid conduit means of said liquid-transmitting manifold means into first and second jetting and lifting zones, each extending substantially halfway about the interior of said housing means and partially encircling said generally upright axis of said housing means, said selectively operable liquid conduit closure means being further selectively operable to provide liquid communications between said first and second jetting and lifting zones;

said liquid flow control means includes first liquid supply conduit means operable to supply pressurized liquid to said first jetting and lifting zone, first selectively operable, liquid valve means operable to control the flow of pressurized liquid through said first liquid supply conduit means, second liquid supply conduit means operable to supply pressurized liquid to said second jetting and lifting zone, and second selectively operable liquid valve means operable to control the flow of pressurized liquid through said second liquid supply conduit means;

said apparatus further includes gas lift intensifying and localizing means including gas transmitting manifold divider means operable to divide said gas transmitting manifold means into a plurality of separate and independently operable gas lift zones, each containing at least some of said gas outlets and being disposed generally above a said jetting and lifting zone, gas flow control means selectively operable to direct gas alternately to selective ones of said gas lift zones and direct gas to the totality of said gas lift zones;

said gas transmitting manifold divider means and said gas flow control means being selectively operable, in cooperation, to intensify and localize the gas-lift effect provided by said gas outlets of said gas transmitting manifold means in the vicinity of a selected one of said gas lift zones, or provide a generally uniform gas-lift effect throughout the interior of said housing means;

said gas transmitting manifold means includes generally annular gas conduit means located within said housing means generally above said material receiving opening means and generally above said liquid-transmitting manifold means and generally encircling said generally upright axis of said housing means, said generally annular gas conduit means supporting said gas outlets on an underside thereof;

said gas-transmitting manifold divider includes a pair of selectively operable gas conduit closure means extending generally transversely across generally diametrically opposite interior portions of said generally annular gas conduit means of said gas transmitting manifold means and selectively operable to divide said generally annular gas conduit means of said gas-transmitting manifold means into first and second gas lift zones, each extending substantially halfway about the interior of said housing means and partially encircling said generally upright axis of said housing means, said selectively operable gas conduit closure means being further selectively operable to provide gas communications between said first and second gas lift zones; and said gas flow control means includes first gas supply conduit means operable to supply pressurized gas to said first gas lift zone, first selectively operable gas valve means operable to control the flow of pressurized gas through said first gas supply conduit means, second gas supply conuit means operable to supply pressurized gas to said second gas lift zone, and second selectively operable gas valve means operable to control the flow of pressurized gas through said second gas supply conduit means.

9. An apparatus as described in claim 1 wherein:

said housing means includes an outer shell;

an anti-embedment rim carried by said outer shell and extending transversely outwardly from a lower portion thereof, said anti-embedment rim being operable to impede embedment of said housing means in said submerged surface from which material is to be removed; and a generally frusto-conical, downwardly diverging wall transversely bridging said outer shell above said material-receiving opening means and communicating with said removed material discharging means at an upper apex portion of said generally frusto-conical downwardly diverging wall; and said apparatus further includes a plurality of web means spaced about the exterior of said housing means, connected with said outer shell, and extending outwardly therefrom;

said web means being connected with said anti-embedment rim and providing a connection between said anti-embedment rim and said outer shell operable to provide anti-deflection means supporting an upper side of said anti-embedment rim.

10. An apparatus as described in claim 1 wherein:

said housing means includes an outer shell;

an anti-embedment rim carried by said outer shell and extending transversely outwardly from a lower portion thereof, said anti-embedment rim being operable to impede embedment of said housing means in said submerged surface from which material is to be removed; and a generally frusto-conical, downwardly diverging wall transversely bridging said outer shell above said material-receiving opening means and communicating with said removed material discharging means at an upper apex portion of said generally frusto-conical downwardly diverging wall; and said apparatus further includes a plurality of web means spaced about the exterior of said housing means, connected with said outer shell, and extending outwardly therefrom;

said web means being connected with said anti-embedment rim and providing a connection between said anti-embedment rim and said outer shell operable to provide anti-deflection means supporting an upper side of said anti-embedment rim;

said removed material discharge means extends generally transversely of said generally upright axis of said housing means, toward one side thereof; and said apparatus further includes first balancing means including buoyancy chamber means carried by said housing means beneath a transversely projecting portion of said removed material discharge means, and a plurality of second balancing means dispersed about said housing means and operable to selectively support ballasting means at a plurality of dispersed ballasting locations relative to said housing means.

* * * * *